US006999700B2

(12) United States Patent
Gumbe

(10) Patent No.: US 6,999,700 B2
(45) Date of Patent: Feb. 14, 2006

(54) IMAGE FORMING APPARATUS WITH STOPPER FOR PREVENTING ROTATION OF A DEVELOPING UNIT

(75) Inventor: Eiji Gumbe, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/107,863

(22) Filed: Apr. 18, 2005

(65) Prior Publication Data

US 2005/0180781 A1 Aug. 18, 2005

Related U.S. Application Data

(63) Continuation of application No. 10/938,657, filed on Sep. 13, 2004, now Pat. No. 6,917,778, which is a continuation of application No. 10/301,798, filed on Nov. 22, 2002, now Pat. No. 6,819,898.

(51) Int. Cl.
*G03G 15/01* (2006.01)
*G03G 15/08* (2006.01)

(52) U.S. Cl. ..... 399/227; 399/119

(58) Field of Classification Search ..... 399/227, 399/226, 223, 119, 120, 112
See application file for complete search history.

(56) References Cited

U.S. PATENT DOCUMENTS

| | | | |
|---|---|---|---|
| 4,939,548 | A | 7/1990 | Yamada et al. |
| 5,258,819 | A | 11/1993 | Kimura et al. |
| 5,325,151 | A | 6/1994 | Kimura et al. |
| 5,552,877 | A | 9/1996 | Ishikawa et al. |
| 5,655,190 | A | 8/1997 | Fuchiwaki |
| 5,809,380 | A | 9/1998 | Katakabe et al. |
| 6,072,967 | A | 6/2000 | Sugihara et al. |
| 6,122,469 | A | 9/2000 | Miura et al. |
| 6,336,020 | B1 | 1/2002 | Ishikawa et al. |

FOREIGN PATENT DOCUMENTS

| | | | |
|---|---|---|---|
| JP | 09-244402 A | * | 9/1997 |
| JP | 10-260565 A | * | 9/1998 |
| JP | 11-316479 A | | 11/1999 |
| JP | 2000-172058 A | | 6/2000 |
| JP | 2002-287461 A | | 10/2002 |

* cited by examiner

*Primary Examiner*—Sophia Chen
(74) *Attorney, Agent, or Firm*—Foley & Lardner LLP

(57) ABSTRACT

An image forming apparatus includes a main body, an image carrier provided in the main body and configured to retain electrostatic latent images on its surface, and a developing unit including a holding unit holding plural developing devices, rotatably supported by the main body. Further, a driving source is configured to rotate the developing unit and move a desired developing device to a developing position opposed to the image carrier. A stopping member is configured to be moved to an unstopping position unengaged with the holding unit and to a stopping position to stop a one-way direction rotation of the developing unit at an exchanging position for exchanging the developing devices. A backstop member is configured to be moved to a removing position unengaged with the holding unit and to an engaged position engaged with the holding unit to prevent a rotation of the developing unit in a direction opposite the one-way direction rotation.

4 Claims, 5 Drawing Sheets

IMAGE FORMING APPARATUS WITH STOPPER FOR PREVENTING ROTATION OF A DEVELOPING UNIT

The present application is a continuation of U.S. application Ser. No. 10/938,657, filed Sep. 13, 2004, now U.S. Pat. No. 6,917,778 which claims priority of U.S. application Ser. No. 10/301,798, filed Nov. 22, 2002, now U.S. Pat. No. 6,819,898, the entire contents of which are incorporated herein by reference.

BACKGROUND OF THE INVENTION

1. Field of the Invention

The present invention relates to image forming apparatuses such as electro-photographic apparatuses, printers and the like, and an image forming apparatus to get color developed images using a revolver type developing unit.

2. Description of the Related Art

In image forming apparatuses to get color images according to an electro-photographic system such as color copiers, printers and the like, for achieving the downsizing, an apparatus is developed, which forms latent images corresponding to yellow (Y), magenta (M), cyan (C) and black (BK) on a photosensitive drum by rotating the drum plural times and supplies toners in different colors to the drum from plural developing devices visualizes the formed color images and obtains a full-color image by superposing the visualized toner images on a photosensitive drum or an intermediate transferring substance.

Further, a revolver type developing unit is developed to supply toners in different colors to latent images formed on a photosensitive drum when the drum is rotated. This revolver type developing unit is equipped with 3 developing devices containing yellow (Y), magenta (M) and cyan (C) toners and further, a developing device for black (BK) toner added.

For this revolver type developing unit, there are two methods available for removing developing devices from a revolver during the maintenance including a periodic inspection; one method is to pull out developing devices in the longitudinal direction from the opening of the front frame of the main body of an image forming apparatus after rotating the developing unit to a prescribed position and the other method is to take out developing devices in the direction vertical to the shaft of a revolver from the side frame of the main body of an image forming apparatus after rotating a developing unit to a prescribed position.

In both methods, it is necessary to prevent a developing unit from rotating in the reverse direction for a malfunction when a developing unit is unbalanced when removing developing devices from a revolver. In Japanese Patent Application No. 11-316479, a device is disclosed to prevent the rotation of a developing unit in the reverse direction. This device prevents the rotation of a developing unit that is positioned using a stepping motor by engaging a plunger into a notch or prevents the reverse rotation of a developing unit by providing a one-way clutch to a central shaft of a developing unit. Thus, the reverse rotation of a developing unit when removing developing devices is prevented.

However, in the above-mentioned conventional image forming apparatus, developing devices are removed by stopping a developing unit in the state with voltage or current applied to a stepping motor for driving the developing unit. Therefore, for example, even when a developing unit is blocked to rotate by a plunger or a one-way clutch, there is still the possibility for generating abnormal rotation for a malfunction of a stepping motor.

Furthermore, the above-mentioned conventional image forming apparatus is in such a structure that a one-way clutch is installed to the central shaft of a developing unit and the one-way clutch is easily worn by the rotation of a developing unit, the clutch accuracy drops for its wear and tear and a certain play may be produced during the operation of the one-way clutch. Therefore, for example, when the central shaft of the developing unit rotates in conjunction with the rotation of a developer conveying auger of developing devices, a play is produced when the one-way clutch is operating, and when the developing unit rotates in the reverse direction even if only slightly, not only safety in the developing device removing work is impaired but also the developing devices can be damaged.

Accordingly, a highly reliable image forming apparatus to obtain developed color images using a revolver type developing unit is desired, which is capable of surely preventing the counter-rotation of the developing unit in the removing work of developing devices from a revolver, securing safety during the maintenance and preventing the damage of developing devices held by the developing unit.

SUMMARY OF THE INVENTION

An object of the present invention is to provide an image forming apparatus that is capable of preventing the counter-rotation of a developing unit when exchanging developing devices held by a revolver type developing unit, promoting safety of operator during the maintenance work, and assuring prevention of damage of developing devices or peripheral equipment.

According to a preferred embodiment of the present invention, there is provided an image forming apparatus comprising: an image carrier for holding electrostatic latent images on the surface; a developing unit that has plural developing devices that can be exchanged by a rotatable holding unit and supported rotatably by the main body of the image forming apparatus; a driving source for moving a desired developing device by rotating the developing unit to a developing position opposite to the image carrier; a locking mechanism that is movable to an unlocking position of the holding unit and a locking position to engage with the holding unit for stopping at a position to exchange the developing devices and to a locking position when the driving source is shut off; and a backstop member that is movable to the first free position with the revolver and the second position to engage with the holding unit in order to prevent the rotation of the developing unit in the direction reverse to the rotating direction by the driving source, and to the second position when the driving source is shut off.

Further, according to the preferred embodiment of the present invention, there is provided an image forming apparatus comprising: an image carrier for holding electrostatic latent images on the surface; a developing unit equipped with plural developing devices that can be exchanged by a rotatable revolver and supported rotatably by the main body of the image forming apparatus; a stepping motor for moving a desired developing device by rotating the developing unit to a developing position opposite to the image carrier; a locking mechanism that is movable to an unlocking position with the revolver and a locking position to engage with the revolver for stopping at a position to exchange the developing devices and to a locking position when the stepping motor is shut off; and a backstop gear that is movable to the first free position with the revolver and the second position to engage with the revolver in order to prevent the rotation of the developing unit in the direction reverse to the rotating direction by the stepping motor and to the second position when the stepping motor is shut off.

DETAILED DESCRIPTION OF THE INVENTION

Figure 1:
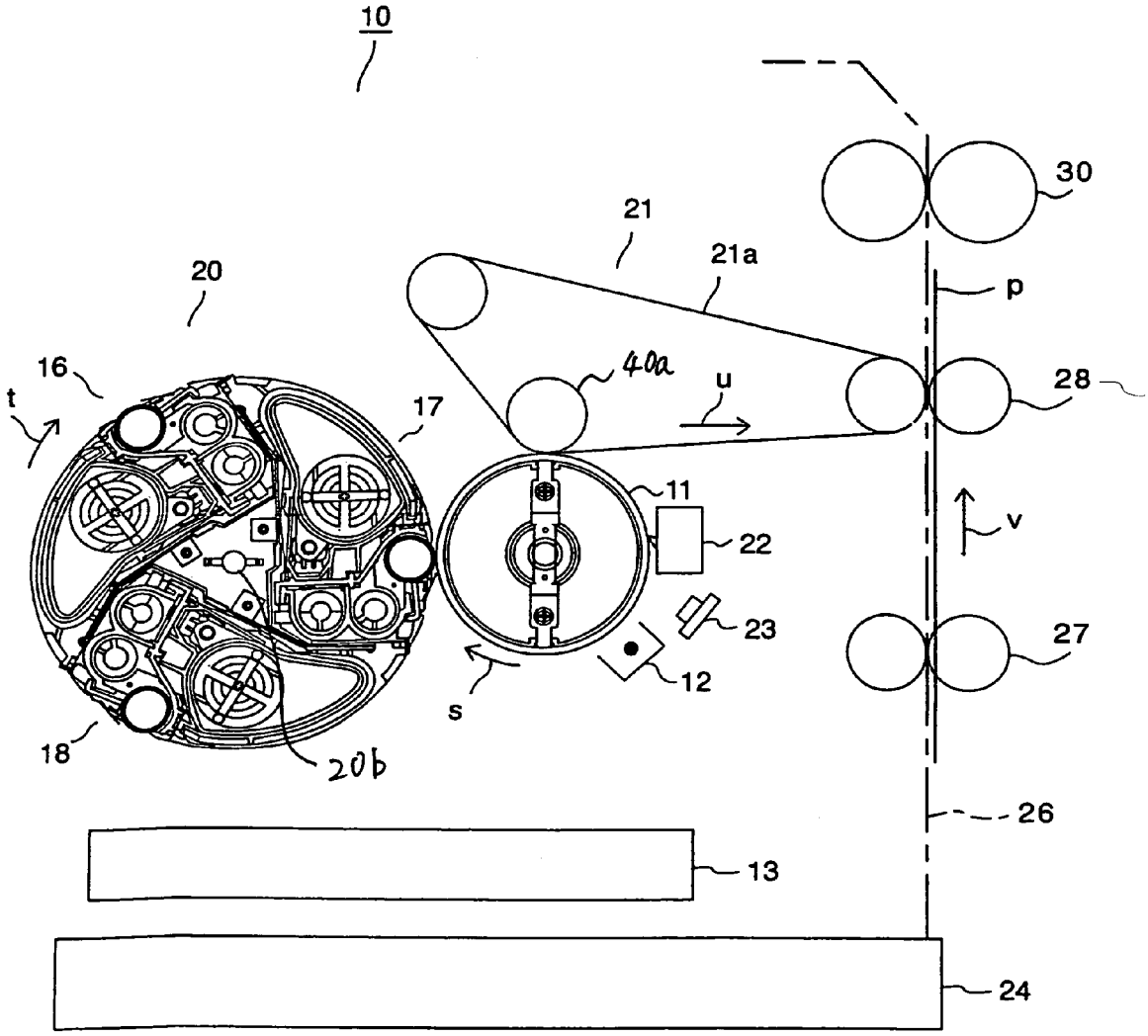
FIG. 1 is a schematic diagram showing the structure of an image forming unit in a preferred embodiment of the present invention.

A preferred embodiment of the present invention will be explained in detail referring to the attached drawings. FIG. 1 is a schematic diagram showing the structure of an image forming unit 10 of an image forming apparatus such as a color printer and the like in the embodiment of the present invention. Around a photosensitive drum 11 that is an image carrier of the image forming unit 10, there are provided a charger 12 to uniformly charge the photosensitive drum 11 sequentially with the rotation of the photosensitive drum 11 in the arrow direction s, a laser writing unit 13 that is a latent image forming unit for forming latent images on the charged photosensitive drum 11, first through third developing devices 16–18 containing three color toners; yellow (Y), magenta (M) and cyan (C), a revolver type developing unit 20 that rotates in the arrow direction t centering around a shaft 20*b*, an intermediate transfer device 21 equipped with an intermediate transfer belt 21*a* that rotates in the arrow direction u, a cleaner 22, and a charge elimination lamp 23.

Below the image forming unit 10, there are a paper supply cassette 24 for housing recording paper (not illustrated), an aligning roller pair 27 to synchronize the leading edge of a recording paper to the leading edge of a toner image transferred on the intermediate transfer belt 21*a* along a conveying path 26 of recording paper taken out of the paper supply cassette 24, a secondary transfer roller pair 28 for transferring a toner image secondarily on the intermediate transfer belt 21*a* on a recording paper, and a fixing roller pair 30 for fixing a toner image on a recording paper. The laser wiring unit 13 forms an electrostatic latent image on the photosensitive drum 11 by applying a laser beam corresponding to a writing signal of each color according to image information input from an external computer terminal, etc.

Figure 2:
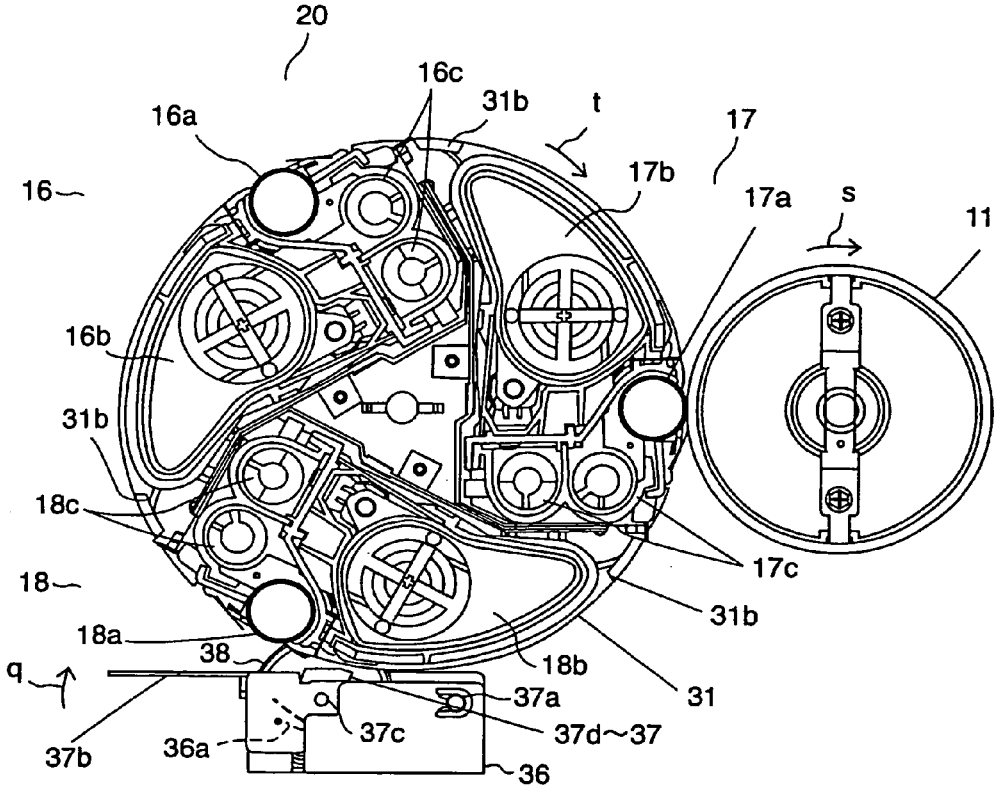
FIG. 2 is a diagram for explaining a developing unit and a stopping member at an unstopping position, viewed from the developing device side in the embodiment of the present invention.

The first through third developing devices 16–18 have first through third developing rollers 16*a*–18*a* and conveying augers 16*c*–18*c* for supplying yellow (Y), magenta (M) and cyan (C) toners in developer containers 16*b*–18*b* to developing rollers 16*a*–18*a*, respectively as shown in FIG. 2.

The developing unit 20 is rotated in the arrow direction t when a stepping motor 41 drive a revolver following gear 40 provided to a revolver 31 that is a holding unit. The developing unit 20 holds the first-third developing devices 16–18 by installing both ends of shafts (not illustrated) of developing rollers 16*a*–18*a* of the first through third developing devices 16–18 to a positioning unit 31*a* that is formed on the revolver 31 through bearings.

Figure 5:
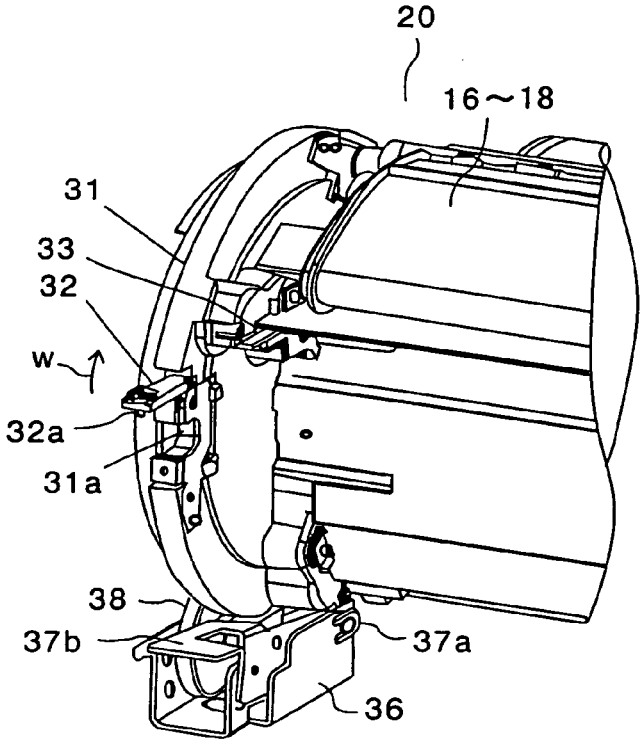
FIG. 5 is a partly perspective diagram showing the developing unit in the state with developing devices removed in the embodiment of the present invention.

As shown in FIG. 5, a developer fixing member 32 is mounted rotatably to the positioning unit 31*a* of the revolver 31 and when the developing devices 16–18 are removed, the positioning unit 31*a* is opened by removing a screw 32*a* and rotating the developing unit fixing member 32 in the arrow direction w. Further, when the developing devices 16–18 are mounted, after rotating the developer fixing member 32 in the reverse direction to the arrow direction w, the developing devices 16–18 are fixed to the revolver 31 by fixing the positioning unit 31*a* with a screw.

Figure 6:
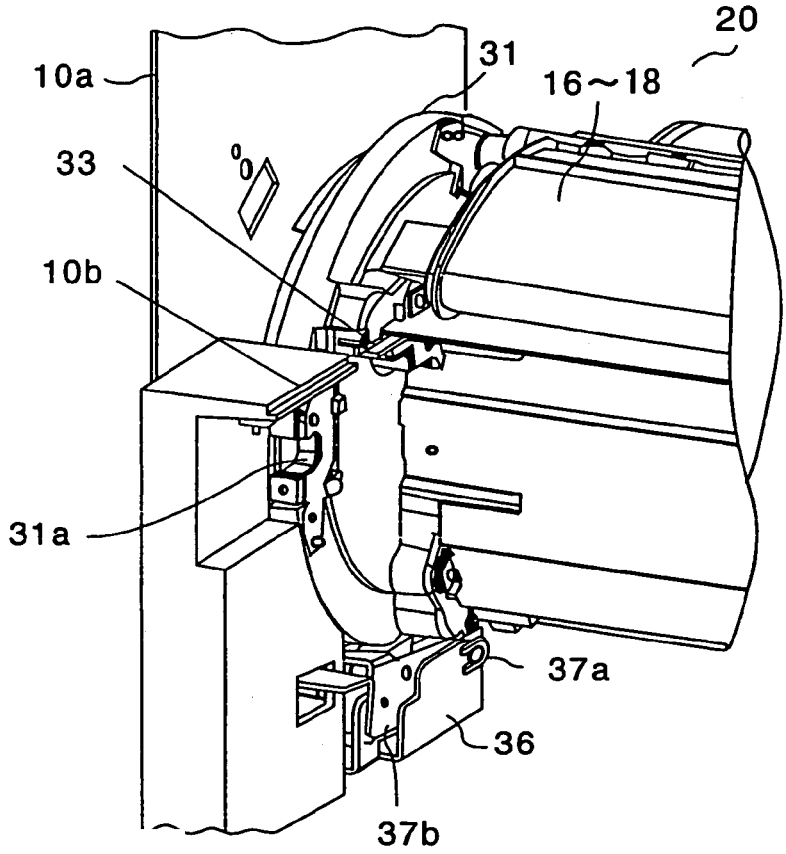
FIG. 6 is a partly perspective diagram showing the developing unit with developing devices removed and a main body guide.

As shown in FIG. 6, a guide 33 is formed on the revolver 31. This guide 33 is a developing device installing guide that is a guide member to guide the developing devices 16–18 to a main body guide 10*b* provided to a frame 10*a* of the image forming apparatus by sliding them in the direction vertical to the shaft 20*b* of the developing unit 20 when the developing devices 16–18 are attached or detached.

Figure 7:
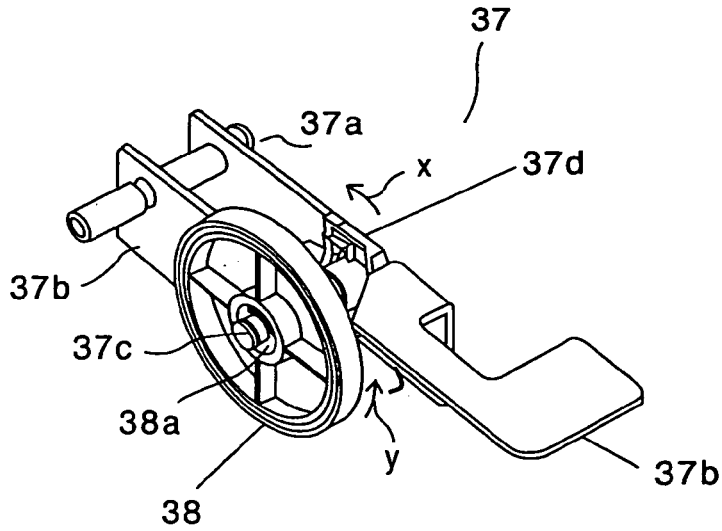
FIG. 7 is a perspective view showing a stopping hook and a backstop gear in the embodiment of the present invention.

Next, the locking mechanism (or stopping member) and the backstop member will be described in detail. The stopping unit 37 has a stopping lever 37*b* that is a supporting member attached rotatably to a fixing member 36 at a supporting shaft 37*a* as shown in FIG. 7. The stopping lever 37*b* supports a stopping hook 37*d* made of polyoxy methylene (POM) that is a stopping member at a supporting shaft 37*c* fixed on the stopping lever 37*b* that is the supporting member. When the stopping hook 37*d* is at the stopping position by the rotation of the stopping lever 37*b*, it stops a stop claw 31*b* that is a stopped portion formed as a projection or groove on the revolver 31 to stop the revolver 31 at an exchanging position for exchanging the developing devices 16–18. Further, the stopping hook 37*d* is pushed by the stop claw 31*b* and bent elastically about 5° in a reverse direction to the arrow direction x.

Figure 8:
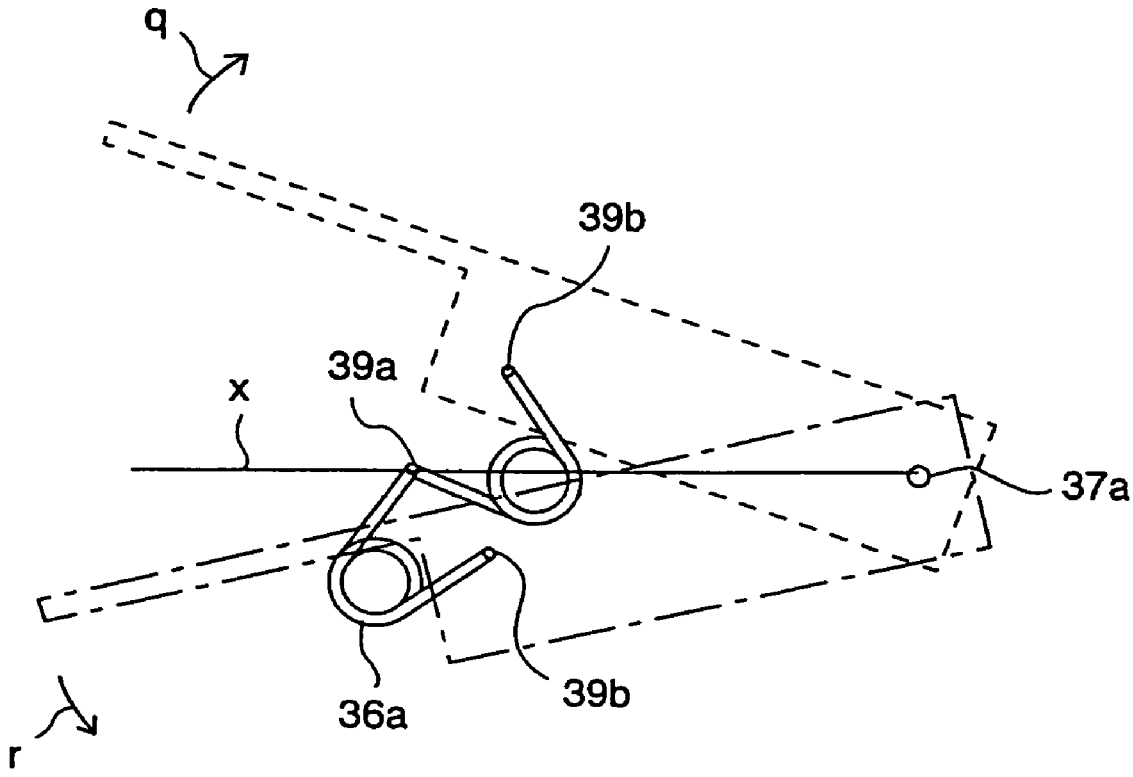
FIG. 8 is an explanatory diagram showing a toggle spring in the embodiment of the present invention.

The stopping lever 37*b* has been compressed to the unstopping position shown in FIG. 2 by a toggle spring 36*a* attached to the fixing member 36 shown in FIG. 8. When the stopping lever 37*b* is rotated in the arrow direction q, it has been compressed in the arrow direction q by the toggle spring 36*a*. The stationary side 39*a* of the toggle spring 36*a* is attached to the fixing member 36 and the moving side 39*b* is attached to the stopping lever 37*b*. The toggle spring 36*a* has actions to compress the stopping lever 37*b* in the arrow direction q when its moving side 39*a* moves to above a line X that is connecting the supporting point of the stopping lever 37*b* and the stationary side 39*a* of the toggle spring 36*a* and compresses the stopping lever 37*b* in the arrow direction r when the moving side 39*b* moves to below the line X.

Accordingly, when the stopping lever 37*b* is turned to the arrow q side as shown by the dotted line, the toggle spring 36*a* compresses the stopping lever 37*b* to the state turned to the arrow q side. On the other hand, when the stopping lever 37*b* is turned to the arrow direction r side as shown by the one-dot chain line, the toggle spring 36*a* compresses the stopping lever 37*b* to the state turned to the arrow r side.

Further, a backstop gear 38 that is a backstop member having a built-in one-way clutch 38*a* is mounted to the support shaft 37*c* of the stopping lever 37*b*. As a result, the backstop gear 38 cannot turn in the arrow direction y shown in FIG. 7. Further, the support shaft 37*c* coaxially supports the stopping hook 37*d* and the backstop gear 38. When the stopping hook 37*d* is at the stopping position by the rotation of the stopping lever 37*b*, the backstop gear 38 engages with a revolver following gear 40 formed on the revolver 31. Thus, the backstop gear 38 prevents the reverse rotating direction to the arrow direction t of the developing unit 20. Further, the backstop gear 38 is in an unengaged position wherein it does not engage with the revolver following gear 40 by the rotation of the stopping hook 37*d* when the stopping hook 37*d* is at the unstopping position.

Next, the color image forming process by the image forming unit 10 will be explained. In this image forming unit 10, a full-color image is formed by superposing yellow (Y), magenta (M) and cyan (C) toner images in this order. When the image forming process is started, a developing roller 16*a* of the yellow (Y) developing device 16 of the developing unit 20 is arranged at the developing position opposite to the photosensitive drum 11.

When the image forming process is started, the photosensitive drum 11 rotates in the arrow direction s and is uniformly charged by the charger 12, and the laser-writing unit 13 applies a laser beam according to a yellow image signal. Thus, a yellow electrostatic latent image is formed on the photosensitive drum 11. This yellow (Y) toner is electrostatically supplied to the developing roller 16*a* when reaches the developing unit 20 and a yellow (Y) toner image is formed.

Then, when the toner image formed on the photosensitive drum 11 reaches a position to contact the intermediate transfer belt 21 that is turned in the arrow direction u, the yellow toner image is electrostatically transferred primarily on the intermediate transfer belt 21 by the transfer bias from the primary transfer roller 40*a*. After the primary transfer, the photosensitive drum 11 is cleaned and the cleaner 22 removes residual toner and the charge elimination lamp 23 removes the charge on the surface.

Thereafter, in the similar manner as the yellow toner image forming process, the magenta and cyan toner image forming processes are repeated on the photosensitive drum 11 and further, the yellow (Y), magenta (M) and cyan (C) toner images are intermediately transferred sequentially on the intermediate transfer belt 21*a* from the photosensitive drum 11 and a color toner image with 3 color toners superposed is formed on the intermediate transfer belt 21*a*. During these processes, the developing unit 20 is rotated in the arrow direction t by the stepping motor and the developing rollers 16*a*–18*a* corresponding to toner image colors formed on the photosensitive drum 11 is arranged opposing to the photosensitive drum 11.

The yellow (Y), magenta (M) and cyan (C) color toner images that are superposed on the intermediate transfer belt 21*a* are transferred in a lump on a recording paper that is taken out in the arrow direction v from the paper supply cassette 24 and conveyed to the secondary transfer roller pair 28 in synchronous with the color toner images. A full-color image is thus completed on a recording paper P.

While the image forming process is repeated as described above, the exchange maintenance of the developing devices 16–18 is executed when a prescribed number of image forming sheets is reached or a prescribed time elapsed. When starting the exchange maintenance, operator should first pull out the power cord of the main body of the image forming apparatus to prevent the abnormal rotation of the developing unit 20 for a malfunction, etc. of the stepping motor 41 and make the drive of the developing unit 20 free and rotatable manually. Then, operator opens the side cover of the main body of the image forming apparatus and rotates the stopping lever 37*b* held at the unstopping position shown in FIG. 2 in the arrow direction q. Thus, the stopping lever 37*b* released from the unstopping position is compressed by the toggle spring 36*a* in the arrow direction q and is held at the stopping position shown in FIG. 3.

Figure 4:
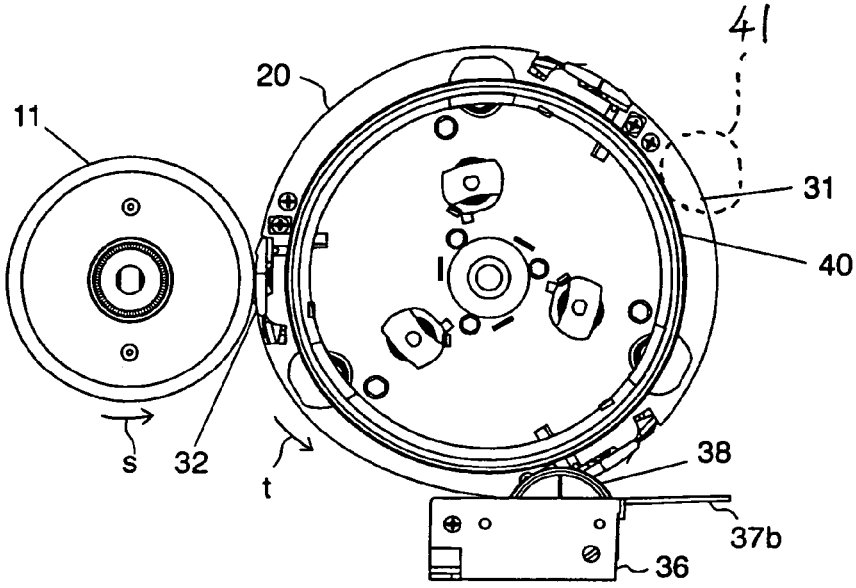
FIG. 4 is a diagram for explaining the developing unit and the stopping member at an unstopping position, viewed from the revolver side.

At this time, the backstop gear 38 engages the revolver following gear 40 and prevents the developing unit 20 from rotating in the reverse direction to the arrow direction t in FIG. 4.

Figure 3:
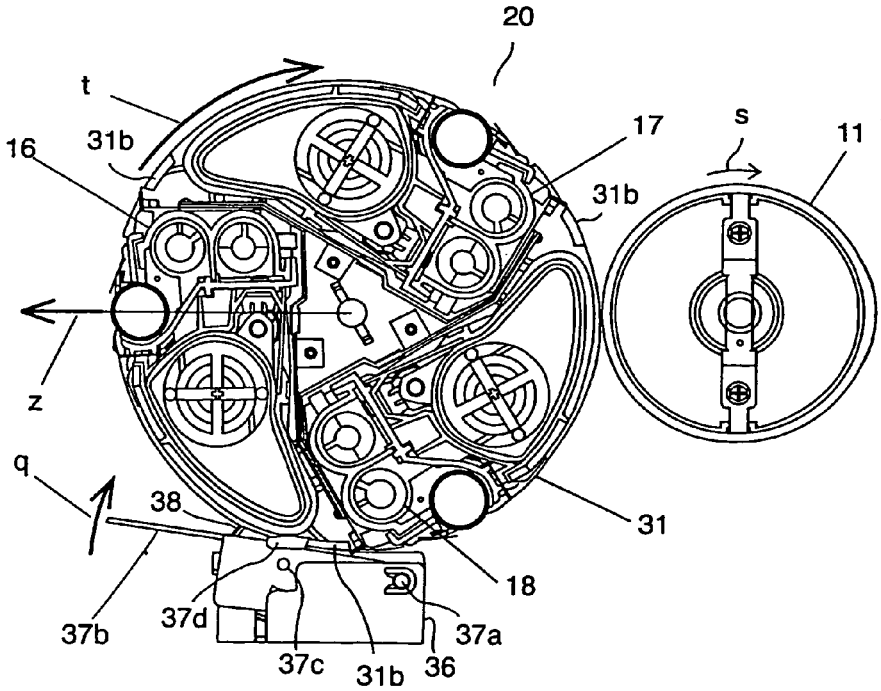
FIG. 3 is a diagram for explaining the developing unit and a stopping member at a stopping position, viewed from the developing device side in the embodiment of the present invention.

When the developing unit 20 is manually rotated in the arrow direction t and the exchanging position for exchanging the developing devices 16–18 is reached under this state, the revolver stop claw 31*b* runs against the stopping hook 37*d* of the stopping lever 37*b* and the developing unit 20 is stopped at the exchanging position for exchanging the developing devices 16–18 in FIG. 3.

Further, this time, the stopping hook 37*d* is pushed by the stop claw 31*b* and bent elastically about 5° in a reverse direction to the arrow direction x.

Then, the operator should open a developer fixing member 32 in the arrow direction w by removing a screw 32*a*, pull out the developing devices 16–18 in the direction vertical to the shaft 20*b* of the developing unit 20 from the positioning unit 31*a*, slide a developing device mounting guide 33 in the arrow direction z along the developing devices mounting guide 33 shown in FIG. 3 or 5 and take out from the main body of the image forming apparatus along the main body guide 10*b*. Then, the operator loads the main body of the image forming apparatus with new developing devices 16–18 along the main body guide 10*b* and the developing device mounting guide 33, and after mounting the shafts of the developing rollers 16*a*–18*a* to the positioning unit 31*a* of the revolver 31, fix the developing device fixing member 32 to the positioning unit 31*a* with a screw and fix it to the revolver 31.

Then, the operator rotates the stopping lever 37*b* once in the reverse direction to the arrow direction q and after removing the stopping hook 37*d* from the revolver stop claw 31*b*. At this time the stopping hook 37*d* is free and reforms its shape from the bent state.

And then the operator returns the stopping lever 37*b* to the stopping position by rotating it in the arrow direction q again. Therefore, even when returned to the stopping position, the stopping hook 37*d* does not engage with the revolver-stop claw 31*b* and the developing unit 20 can be turned manually.

When the developing unit 20 is rotated manually in the arrow direction t under this state, the stopping hook 37*d* stops a next revolver stop claw 31*b* and the developing unit 20 is stopped at a next exchanging position for exchanging next developing devices 16–18. Hereafter, in the similar manner as described above, the operator exchanges next color developing devices 16–18.

While exchanging the developing devices 16–18, the developing unit 20 is firmly stopped at the exchanging position by the stopping hook 37*d* attached to the stopping lever shaft 37*c* fixed on the stopping lever 37*b* and the backstop gear 38 attached to the stopping lever shaft 37*c*.

That is, the rotation of the developing unit 20 in the arrow direction t is blocked by the stopping hook 37*d* that stops the stop claw 31*b* formed on the revolver 31. On the other hand, the backstop gear 38 that is engaging with the revolver following gear 40 blocks the rotation of the developing unit 20 in the reverse direction to the arrow direction t. Furthermore, when the developing unit 20 tries to rotate in the direction reverse to the arrow direction t, a force to inroad into the revolver following gear 40 side acts on the backstop gear 38 for its effect of arrangement and despite of the back stop gear 38 being compressed only in the arrow direction q by the toggle spring 36*a*, the reverse rotation of the developing unit 20 can be surely prevented without the possibility of disengagement of the backstop gear 38 and the revolver following gear 40.

When the developing devices 16–18 in three colors of yellow (Y), magenta (M) and cyan (C) are thus exchanged completely, the image forming process can be executed when the stopping lever 37*b* is depressed in the direction reverse to the arrow direction q, the stopping lever 37*b* is held at the unstopping position by the toggle spring 36*a*, the side cover is closed, a power cord of the main body of the image forming apparatus is connected, and the power is turned on.

According to the above-mentioned embodiment, when the developing unit 20 is manually rotated in the state with the stopping lever 37*b* rotated and the stopping hook 37*d* moved to the stopping position for exchanging the developing devices 16–18, the reverse rotation of the developing unit 20 is prevented easily and surely and the developing unit 20 can be stopped at the exchanging position for exchanging the developing devices 16–18 surely. Accordingly, in the maintenance for exchanging the developing devices 16–18, the operator's safety is secured and the damage of the developing devices or their peripheral equipment caused by the reverse rotation of the developing unit 20 can be prevented. Further, the power source of the stepping motor 41 is shut off in the exchange maintenance of the developing devices 16–18. Therefore, the developing unit 20 does not cause abnormal rotation for the malfunction of the stepping motor and further safety is obtained.

Furthermore, there is no possibility for deterioration of the one-way clutch 38*a* provided to the backstop gear 38 for wear, its clutching accuracy can be maintained satisfactorily and the reverse rotation of the developing unit 20 can be prevented at a high accuracy. Further, as the developing device mounting guide 33 is formed on the revolver 31, the old developing devices 16–18 until reaching the main body guide 10*b* can be easily taken out and the contamination of the peripheral portions in taking out the developing devices can be reduced.

Further, the present invention is not limited to the embodiment described above and various changes may be made without departing from the spirit and scope thereof. For example, toner colors in the developing devices held in the developing unit are not limited and further, one developing device containing black toner may be added and four developing devices may be provided. In addition, the image forming apparatus can be in any construction and for example, a developing device containing black toner may be arranged around the image carrier separately from the developing unit.

As described above in detail, according to the present invention, the developing unit can be stopped at the exchanging position for exchanging the developing devices easily and certainly by manually rotating the developing unit after shutting off a driving source with the stopping member moved from the unstopping position to the stopping position and also the reverse rotation of the developing unit can be prevented by the backstop member that can be moved with the stopping member. Accordingly, in the exchange maintenance of the developing devices, the operator' safety can be secured and damage of the developing devices or peripheral equipment can be prevented certainly. In addition, the further safety is assured without causing the abnormal rotation of the developing unit for the erroneous operation of the driving source.

What is claimed is:

1. An image forming apparatus comprising:

an image carrier configured to retain electrostatic latent images on its surface;

a rotatable developer including a revolver configured to hold a plurality of developing devices;

a motor configured to rotate the developer in an image forming direction and to move a selected developing device of the plurality of developing devices to a developing position opposed to the image carrier; and a stopper configured to be movable between an unstopping position and a stopping position, wherein, when the stopper is in the stopping position, the stopper engages with a projection on the revolver and prevents rotation of the revolver both in the image forming direction and in a direction opposite the image forming direction, and wherein, when the stopper is in the stopping position, the revolver is stopped such that at least one of the developing devices is at an exchanging position for being exchanged.

2. The image forming apparatus of claim 1, wherein the stopper includes a lever to rotatably move the stopper between the unstopping position and the stopping position.

3. The image forming apparatus of claim 1, wherein the revolver holds at least three developing devices along a circumference of the revolver.

4. The image forming apparatus of claim 3, wherein each of the at least three developing devices includes a developing container and a developing roller.

* * * * *